US008425205B2

(12) United States Patent
Li et al.

(10) Patent No.: US 8,425,205 B2
(45) Date of Patent: Apr. 23, 2013

(54) CENTRIFUGAL PUMP

(75) Inventors: Min Li, Shenzhen (CN); Cheng Zhuang Zhu, Shenzhen (CN)

(73) Assignee: Johnson Electric S.A., Murten (CH)

( * ) Notice: Subject to any disclaimer, the term of this patent is extended or adjusted under 35 U.S.C. 154(b) by 293 days.

(21) Appl. No.: 12/818,648

(22) Filed: Jun. 18, 2010

(65) Prior Publication Data

US 2010/0322794 A1 Dec. 23, 2010

(30) Foreign Application Priority Data

Jun. 19, 2009 (CN) ..... 2009 1 0108211

(51) Int. Cl.
*F04B 49/00* (2006.01)
*F04B 35/04* (2006.01)

(52) U.S. Cl.
USPC ..... 417/295; 417/423.1

(58) Field of Classification Search ..... 417/410.1, 417/423.1, 423.14, 295, 435; 415/208.1, 415/208.3, 206, 189
See application file for complete search history.

(56) References Cited

U.S. PATENT DOCUMENTS 1,608,547 A * 11/1926 O'Fallon ..... 415/189
1,673,151 A * 6/1928 Lindemann ..... 415/189
2,202,790 A * 5/1940 Forrest ..... 415/121.2
2,639,671 A * 5/1953 Wagner ..... 415/11
2,941,474 A * 6/1960 Hall ..... 417/83
3,048,117 A * 8/1962 Franzen et al. ..... 417/423.14
3,221,661 A * 12/1965 Swearingen ..... 417/370
3,299,820 A * 1/1967 Campbell ..... 415/72
3,425,355 A * 2/1969 MacFarland et al. .... 417/423.14
3,542,496 A * 11/1970 Smith et al. ..... 417/423.1
3,612,714 A * 10/1971 Ruspino ..... 415/116
4,052,133 A * 10/1977 Yeater ..... 415/200
4,129,402 A * 12/1978 Eberhardt ..... 415/56.1
4,239,453 A * 12/1980 Hergt et al. ..... 415/208.1
4,643,639 A * 2/1987 Caine ..... 415/148
4,676,717 A * 6/1987 Willyard et al. ..... 415/196
5,100,289 A * 3/1992 Caoduro ..... 415/56.5
5,156,522 A * 10/1992 Tessier ..... 415/58.2
5,156,535 A * 10/1992 Budris et al. ..... 417/423.7
5,257,901 A * 11/1993 Malchow ..... 415/182.1
5,277,232 A * 1/1994 Borsheim ..... 141/65
5,930,852 A * 8/1999 Gravatt et al. ..... 4/541.1
6,017,187 A * 1/2000 Mueller ..... 415/208.1
6,056,506 A * 5/2000 Martin et al. ..... 415/204
6,059,541 A * 5/2000 Beckey et al. ..... 417/295
6,074,166 A * 6/2000 Moddemeijer ..... 415/109
6,102,657 A * 8/2000 Chalberg et al. ..... 415/204
6,206,632 B1 * 3/2001 Gallus ..... 415/144
6,264,441 B1 * 7/2001 Marioni ..... 417/423.1
6,273,677 B1 * 8/2001 Wang et al. ..... 415/191
6,428,268 B1 * 8/2002 Addie et al. ..... 415/1

(Continued)

*Primary Examiner* — Devon Kramer
*Assistant Examiner* — Alexander Comley
(74) *Attorney, Agent, or Firm* — Muncy, Geissler, Olds & Lowe, PLLC

(57) ABSTRACT

A centrifugal pump has a pump unit and a drive unit. The pump unit includes a volute and an impeller disposed in the volute. The drive unit has a stator and a rotor having a shaft. The volute includes an inlet, an outlet and a chamber in communication with the inlet and outlet. The inlet is coaxial with the chamber. The shaft of the rotor extends into the chamber of the volute and the impeller is attached to and driven by the shaft. The volute further includes a baffle installed in the inlet. The baffle includes a guide plate angled to the axis of the inlet.

12 Claims, 4 Drawing Sheets

U.S. PATENT DOCUMENTS

| | | | | |
|---|---|---|---|---|
| 6,564,595 | B2 * | 5/2003 | Junk et al. | 68/208 |
| 6,640,384 | B2 * | 11/2003 | Sanders et al. | 15/330 |
| 6,837,692 | B2 * | 1/2005 | Martinello | 417/299 |
| 7,001,148 | B2 * | 2/2006 | Cardenas et al. | 415/196 |
| 7,055,866 | B2 * | 6/2006 | Tempas | 285/148.23 |
| 7,544,041 | B2 * | 6/2009 | Mayleben et al. | 415/171.1 |
| 2002/0100299 | A1 * | 8/2002 | Junk et al. | 68/208 |
| 2002/0122731 | A1 * | 9/2002 | Marioni | 417/352 |
| 2005/0196296 | A1 * | 9/2005 | Zanello | 417/363 |
| 2006/0275162 | A1 * | 12/2006 | Mayleben et al. | 417/423.1 |
| 2007/0036665 | A1 * | 2/2007 | Paulin et al. | 417/435 |
| 2007/0059168 | A1 * | 3/2007 | Xu | 415/206 |
| 2008/0080987 | A1 * | 4/2008 | Zhang et al. | 417/319 |

* cited by examiner

CENTRIFUGAL PUMP

CROSS REFERENCE TO RELATED APPLICATIONS

This non-provisional patent application claims priority under 35 U.S.C. §119(a) from Patent Application No. 200910108211.6 filed in The People's Republic of China on Jun. 19, 2009.

FIELD OF THE INVENTION

This invention relates to a centrifugal pump and in particular, to a centrifugal drain pump for a washing machine or the like.

BACKGROUND OF THE INVENTION

Centrifugal pumps are often used as drain pumps in washing machines or dishwashers. In actual application, the pump is mounted inside of the machine and activated automatically during operation by the control circuit of the machine, mainly to pump out the water from the machine. The whole operation can be divided into three stages: the starting stage, the full water stage and the air-water stage. The air-water stage is the last stage during which most of the water has already been pumped out and only residual water mixed with air, flows through the pump. In general, the air-water stage is the noisiest phase of operation, with the noise level significantly greater than the noise level of the starting or full water stages.

Hence there is a desire for a quieter centrifugal pump, especially when the pump is operating in the air-water stage.

SUMMARY OF THE INVENTION

This is achieved in the present invention by using a centrifugal pump with a baffle disposed in the pump inlet.

Accordingly, in one aspect thereof, the present invention provides a centrifugal pump comprising: a pump unit comprising a volute which comprises: an inlet, an outlet and a chamber in communication with the inlet and outlet; and an impeller disposed in the chamber of the volute; and a drive unit comprising a stator and a rotor including a shaft, the shaft of the drive unit extending into the chamber of the volute, the impeller being attached to and driven by the shaft; wherein the inlet is coaxial with the chamber; and a baffle disposed in the inlet, the baffle comprising a guide plate angled to the axis of the inlet.

Preferably, the guide plate comprises a contact edge contacting an inner surface of the inlet and a free edge spaced from the inner surface of the inlet, a passage through the inlet being formed between the free edge and the inner surface of the inlet.

Preferably, a drain slot is formed between the contact edge of the guide plate and the inner surface of the inlet.

Preferably, the impeller is coaxial with the chamber, the axis of the impeller passing through the contour of the guide plate.

Preferably, the baffle further comprises a cylindrical portion extending from the periphery of the contact edge along a direction parallel to the axis of the inlet, and a mounting portion formed at an end of the cylindrical portion remote from the guide plate, the mounting portion abutting against a shoulder formed in the inlet, adjacent the chamber of the volute.

Preferably, at least one rib is formed on one of the inner surface of the inlet and the outer surface of the cylindrical portion of the baffle, at least one recess is formed in the other of the inner surface of the inlet and the outer surface of the cylindrical portion of the baffle, and the at least one rib is received in the at least one recess.

Preferably, at least one post is formed on one of the shoulder of the inlet and the mounting portion of the baffle, at least one mounting hole is formed at the other of the shoulder of the inlet and the mounting portion of the baffle, and the at least one post is fixed in the at least one mounting hole.

Preferably, the angle formed between the guide plate and the axis of the inlet is in the range of 45 to 70 degrees.

Preferably, the rotor comprises a permanent magnet attached to the shaft, and the stator comprises a mounting structure having a mounting plate attached to the volute and a hollow cylinder extending from one side of the mounting plate, the shaft and magnet being disposed in the cylinder.

Preferably, the drive unit is a synchronous motor and the stator comprises a stator core located outside of the cylinder with pole faces confronting the rotor and at least one stator winding wound about the stator core.

Preferably, the impeller is connected to the shaft by a lost motion clutch.

BRIEF DESCRIPTION OF THE DRAWINGS

A preferred embodiment of the invention will now be described, by way of example only, with reference to figures of the accompanying drawings. In the figures, identical structures, elements or parts that appear in more than one figure are generally labelled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
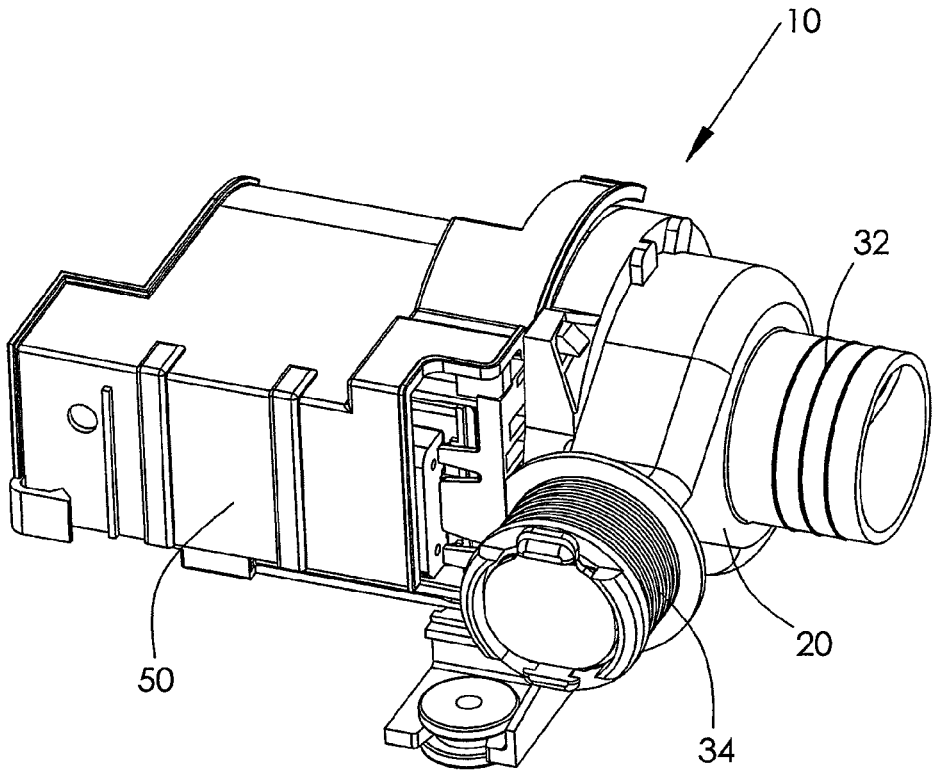
FIG. 1 is an isometric view of a centrifugal pump in accordance with a preferred embodiment of the present invention.
Figure 2:
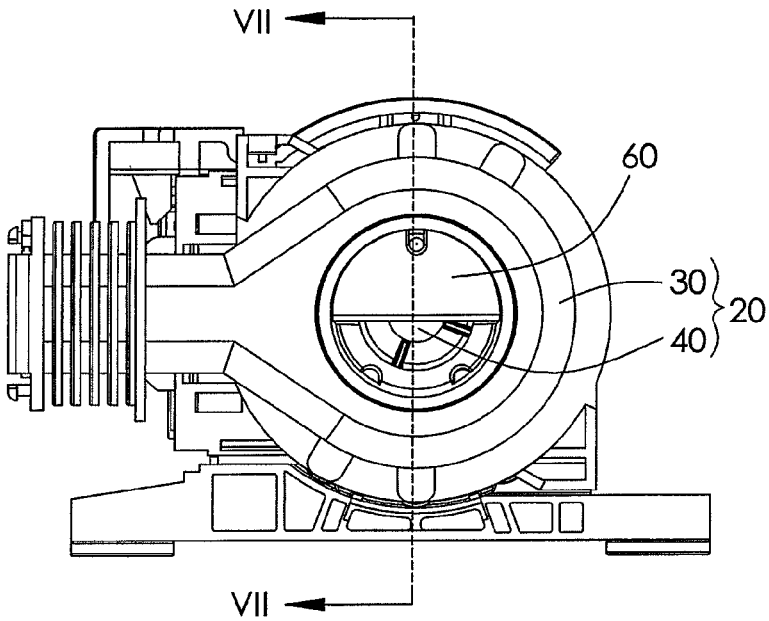
FIG. 2 is an end view of the pump of FIG. 1.
Figure 7:
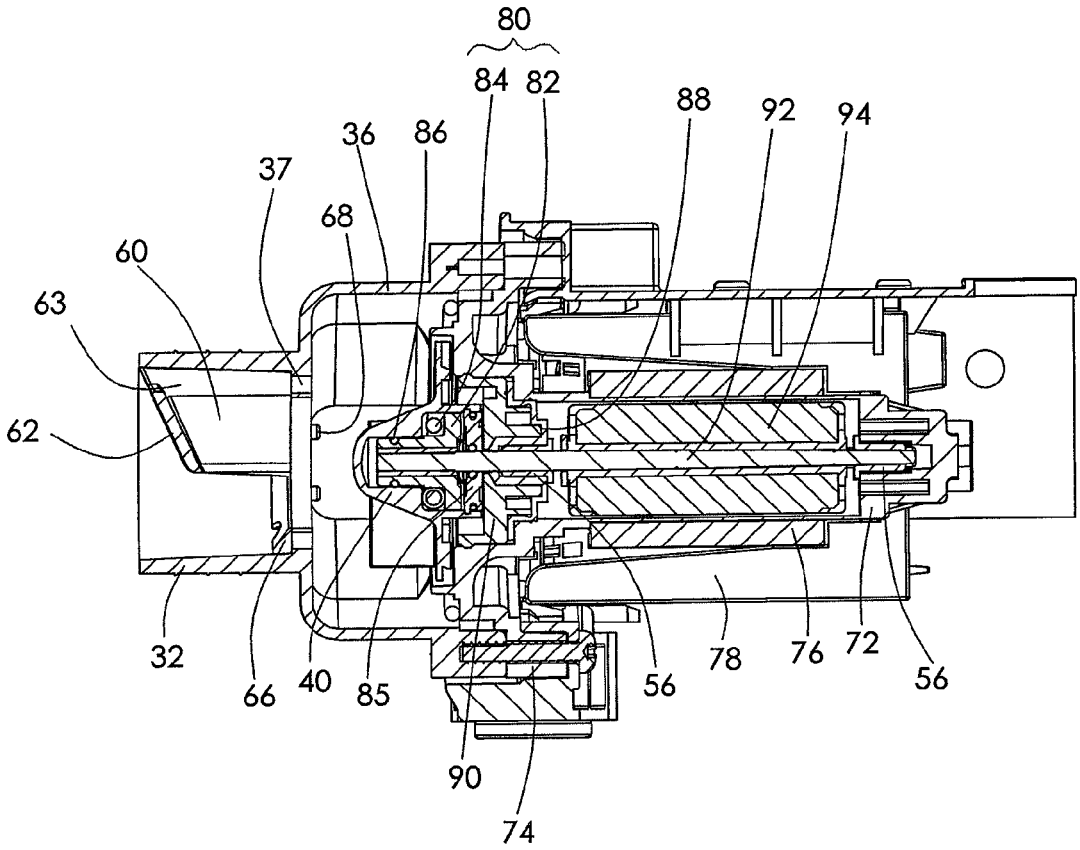
FIG. 7 is a cross sectional view of the pump of FIG. 1.

A centrifugal pump 10, according to the preferred embodiment of the present invention shown in FIGS. 1, 2 and 7, comprises a pump unit 20 and a drive unit 50. The pump unit 20 comprises a volute 30 and an impeller 40 disposed within the volute 30. The drive unit 50 is preferably, a synchronous motor with a permanent magnet rotor and a wound stator.

Figure 3:
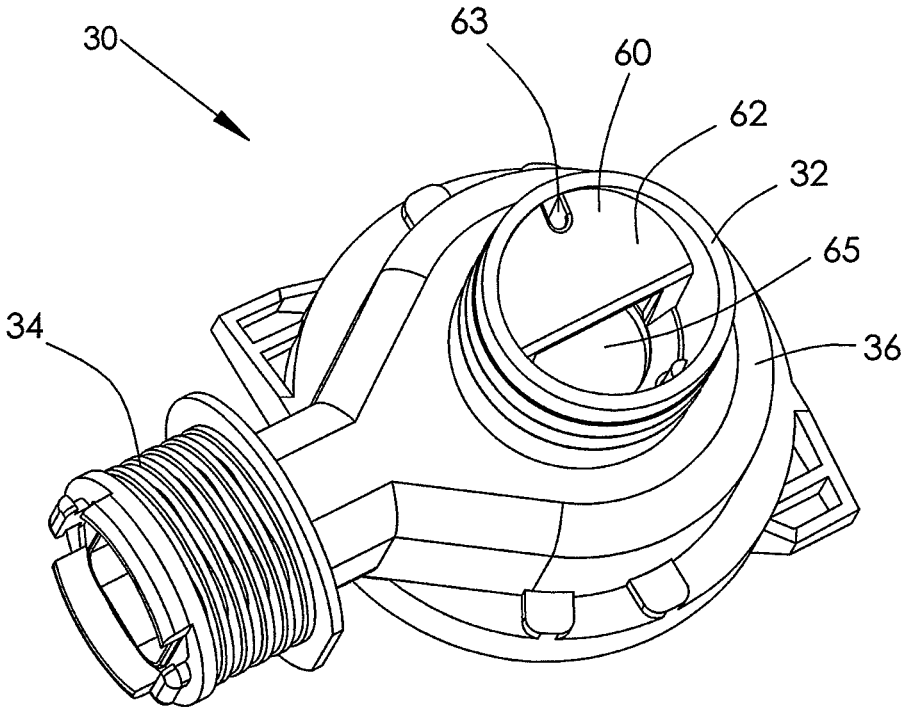
FIG. 3 is an isometric view of a volute, being a part of the pump of FIG. 1.
Figure 4:
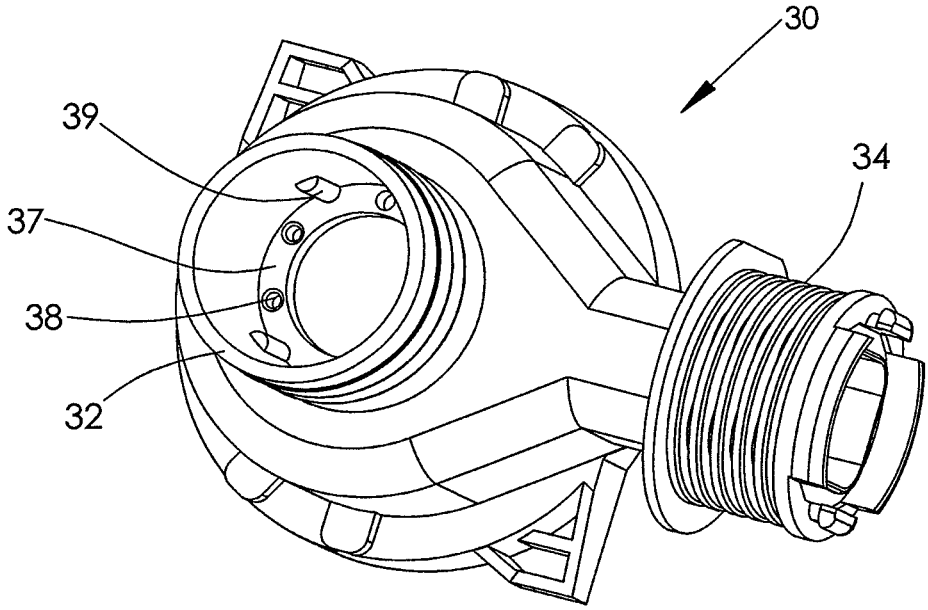
FIG. 4 is a different view of the volute of FIG. 3, with a part removed to show more detail of the inlet of the volute.

The volute 30, as shown more clearly in FIGS. 3 and 4, comprises an inlet 32, an outlet 34 and a chamber 36 in communication with the inlet 32 and outlet 34. The orientation of the inlet 32 is generally perpendicular to the outlet 34, that is, the axis of the inlet lies in a plane which is perpendicular to a plane in which the axis of the outlet lies. The impeller 40 is located in the center of the chamber 36 and the axis of the impeller 40 is coaxial with the axis of the chamber 36, which in turn is coaxial with the axis of the impeller, as shown in FIG. 7. An annular shoulder 37 is formed at the end of the inlet 32, joining the chamber 36. A plurality of mounting holes 38 are provided in the shoulder 37. A plurality of ribs 39 which are parallel to the axis of the inlet 32, are formed on the inner surface of the inlet 32. A baffle 60 is installed in the inlet 32.

Figure 5:
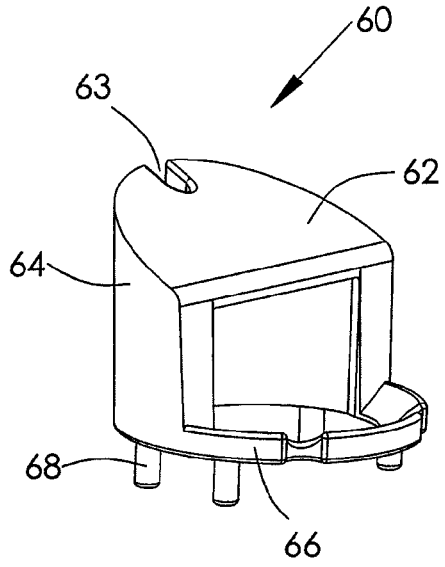
FIG. 5 is an isometric view of a baffle, being a part of the volute of FIG. 3.
Figure 6:
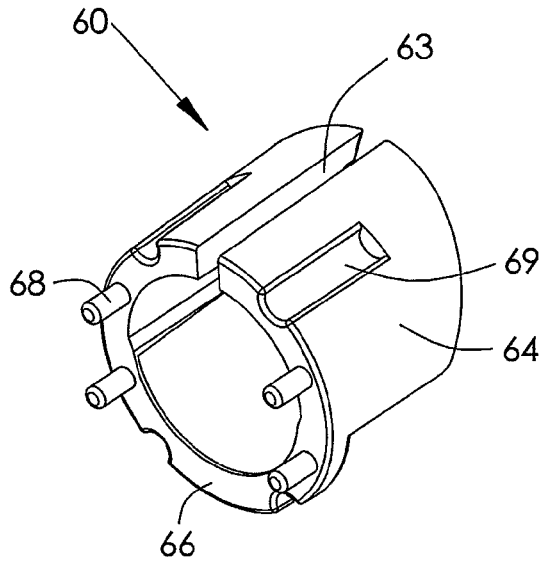
FIG. 6 is a different view of the baffle of FIG. 5.

Referring to FIGS. 3 and 5-6, the baffle 60 comprises a guide plate 62 which has a contact edge configured to contact the inner surface of the inlet 32 and a free edge spaced from the inner surface of the inlet 32. A passage 65 for fluid entering into the chamber through the inlet 32 is formed between the free edge of the guide plate 62 and the inner surface of the inlet 32. The guide plate 62 is angled or inclined to the axis of the inlet 32. Preferably, the angle formed between the guide plate 62 and the axis of the inlet 32 is in the range of 45 to 70 degrees. The free edge of the guide plate 62 extends passed the central axis of the inlet 32. That is, the size of the passage 65 is less than half of the inlet 32 and the axis of the impeller 40 passes through the guide plate 62.

The baffle 60 further comprises a cylindrical portion 64 extending from the periphery of the guide plate 62 along the axis of the inlet 32. An annular mounting portion 66 is formed at an end of the cylindrical portion 64 remote from the guide plate 62. A plurality of posts 68 extend from the mounting portion 66 in a direction parallel to the axial direction of the cylindrical portion 64. A plurality of elongate recesses 69 are formed in the outer surface of the cylindrical portion 64. A drain slot 63 is formed between the baffle 60 and the inner surface of the inlet 32, for escaping of air contained in the mixed water and air which enters into the inlet 32. The drain slot 63 extends through the contact edge of the guide plate 62 and the cylindrical portion 64. When the baffle 60 is installed in the inlet 32 of the volute 30, the annular mounting portion 66 abuts against the shoulder 37 of the inlet 32, the ribs 39 of the inlet 32 are received in the corresponding recesses 69, and the posts 68 of the baffle 60 are fixed into the corresponding mounting holes 38 of the inlet 32 by hot staking or plastic deformation.

Alternatively, the locations of the ribs 39 and recess 69 may be interchanged. The location of the posts 68 and mounting holes 38 may be interchanged.

In use, the baffle should be mounted within the inlet with the drain slot 63 uppermost. In operation of the pump, when mixed water and air enters into the pump 10 via the inlet 32, the guide plate 62 acts to guide water through the inlet 32 while hindering air to pass through the inlet 32, thereby reducing the amount of air contained in the mixed water and air which passed through the inlet 32 into the chamber and therefore reduce the amount of noise generated by the pump, especially in the air-water stage. The air-water stage is when the pump is operating to pump water but there is a large amount of air in the pump, as occurs, for example, when the pump is starting to run dry at the end of the pumping cycle. The air trapped by the baffle can slowly bleed out through the drain slot 63, even when the pump is not operating.

Referring to FIG. 7, the drive unit 50 comprises a rotor and a stator. The rotor comprises a shaft 92 and magnets 94 attached to the shaft 92.

The stator comprises a mounting structure which comprises a hollow cylinder 72 configured to receive the rotor therein. The cylinder has a closed end and an open end. A mounting plate 74 is disposed at the open end of the cylinder 72. The mounting plate 74 defines a plurality of mounting holes for engagement of screws to thereby secure the drive unit 50 and the pump unit 20 together. A first end of the shaft 92 is mounted to the mounting plate 74 via a bearing 56 and a mounting structure 90 which closes the open end of the cylinder. The second end of the shaft 92 is mounted to the closed end of the cylinder 72 via another bearing 56. The first end of the shaft 92 extends through the mounting plate 74 and mounting structure 90 to be connected to the impeller 40, preferably by a lost motion clutch which reduces the starting torque required to operate the pump under full load. As shown the impeller is connected to the shaft 92 via a coupling device 80 disposed inside of the hub 42 of the impeller 40.

The coupling device 80 may be the coupling device disclosed in published US patent application No. 2008/0080987 the content of which is incorporated herein by reference. The coupling device 80 comprises a tube 82 fixedly mounted to the first end of the shaft 92 and balls 84 arranged between the inner surface of the hub 42 of the impeller 40 and the tube 82. The tube 82 has driving teeth extending radially outwardly and the inner surface of the hub 42 has driven teeth extending radially inwardly. When the shaft 92 rotates, the driving teeth of the tube 82 drive the driven teeth of the hub 42 and therefore the impeller 40 to rotate via the balls 84. Circumferential spacing between the balls and the teeth allow limited free movement between the hub and the tube. The inner surface of the end of the hub 42 facing the drive unit 50 defines an annular slot. A cover 85 with a flange is mounted to the end of the hub 42 and the flange of the cover 85 is engaged in the slot of the hub 42 to prevent the coupling device 80 escaping from the inside of the hub 42. Preferably, an elastic or rubber member is axially disposed between the cover 85 and the tube 82. An elastic ring 86 is engaged between the outer surface of the tube 82 and the inner surface of the hub 42 away from the balls 84, to prevent the impeller 40 from wobbling when the impeller 40 rotates. A sealing structure 88 is disposed between the bearing 56 and the mounting structure 90 installed in a mounting opening of the mounting plate 74, to prevent fluid or debris in the pump unit 20 from entering into the drive unit 50 along the shaft 92.

The stator comprises a stator core 76 surrounding the cylinder 72 and windings wound on the stator core 76. An enclosure 78 is attached to the mounting plate 74 and encloses the stator core 76 and windings.

Figure 8:
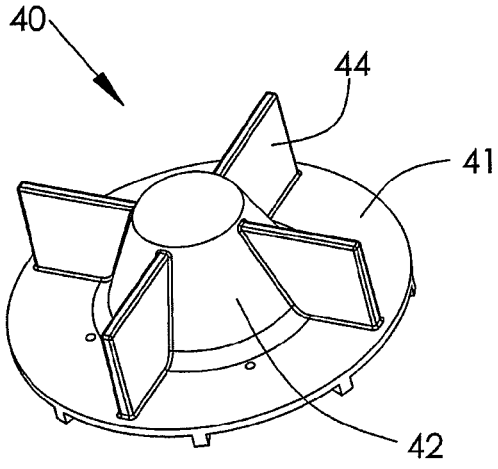
FIG. 8 is an isometric view of an impeller of the pump of FIG. 1.

Referring to FIG. 8, the impeller 40 comprises a bottom plate 41, the hub 42 and blades 44 extending radially from the hub 42. Preferably, the hub 42 has a cone shape.

The pump of the present invention may be used in any kind of washing machine as a drain pump.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A centrifugal pump comprising:

a pump unit comprising: a volute which comprises an inlet, an outlet and a chamber in communication with the inlet and outlet; and an impeller disposed in the chamber of the volute; and a drive unit comprising a stator and a rotor including a shaft, the shaft of the drive unit extending into the chamber of the volute, the impeller being attached to and driven by the shaft;

wherein the inlet is coaxial with the chamber; and a baffle disposed in the inlet, the baffle comprising a guide plate angled to the axis of the inlet, the guide plate comprising a contact edge contacting an inner surface of the inlet and a free edge spaced from the inner surface of the inlet, a passage through the inlet being formed between the free edge and the inner surface of the inlet;

wherein an air passage is formed in the inlet for allowing air in the chamber to bleed out during operation of the pump, the air passage being formed between an outer surface of the baffle and an inner surface of the inlet and being in continuous communication with the chamber.

2. The centrifugal pump of claim 1, wherein the air passage includes a drain slot formed between the contact edge of the guide plate and the inner surface of the inlet.

3. The centrifugal pump of claim 1, wherein the impeller is coaxial with the chamber, an axis of the impeller passing through the free edge of the guide plate.

4. The centrifugal pump of claim 1, wherein the baffle further comprises a cylindrical portion extending from the contact edge along a direction parallel to the axis of the inlet, and a mounting portion formed at an end of the cylindrical portion remote from the guide plate, the mounting portion abutting against a shoulder formed in the inlet, adjacent the chamber of the volute.

5. The centrifugal pump of claim 1, wherein the rotor comprises a permanent magnet attached to the shaft, and the stator comprises a mounting structure having a mounting plate attached to the volute and a hollow cylinder extending from one side of the mounting plate, the shaft and magnet being disposed in the cylinder.

6. The centrifugal pump of claim 5, wherein the drive unit is a synchronous motor and the stator comprises a stator core located outside of the cylinder with pole faces confronting the rotor and at least one stator winding wound about the stator core.

7. The centrifugal pump of claim 1, wherein the impeller is connected to the shaft by a lost motion clutch.

8. The centrifugal pump of claim 1, wherein the inlet has a straight central axis.

9. The centrifugal pump of claim 8, wherein an angle formed between the guide plate and the central axis of the inlet is in the range of 45 to 70 degrees.

10. The centrifugal pump of claim 1, wherein the inlet is coaxial with the impeller.

11. A centrifugal pump comprising:

a pump unit comprising a volute which comprises an inlet, an outlet and a chamber in communication with the inlet and outlet; and an impeller disposed in the chamber of the volute; and a drive unit comprising a stator and a rotor including a shaft, the shaft of the drive unit extending into the chamber of the volute, the impeller being attached to and driven by the shaft;

wherein an air passage is formed in the inlet for allowing air in the chamber to bleed out during operation of the pump;

wherein the pump further comprises a baffle disposed in the inlet, the inlet has a straight central axis and the baffle comprises a guide plate angled to the axis of the inlet;

wherein the guide plate comprises a contact edge contacting an inner surface of the inlet and a free edge spaced from the inner surface of the inlet, a passage through the inlet being formed between the free edge and the inner surface of the inlet;

wherein the baffle further comprises a cylindrical portion extending from the contact edge along a direction parallel to the axis of the inlet and a mounting portion formed at an end of the cylindrical portion remote from the guide plate, the mounting portion abutting against a shoulder formed in the inlet, adjacent the chamber of the volute;

wherein at least one rib is formed on one of the inner surface of the inlet and an outer surface of the cylindrical portion of the baffle, at least one recess is formed in the other of the inner surface of the inlet and the outer surface of the cylindrical portion of the baffle, and the at least one rib is received in the at least one recess.

12. A centrifugal pump comprising:

a pump unit comprising a volute which comprises an inlet, an outlet and a chamber in communication with the inlet and outlet; and an impeller disposed in the chamber of the volute; and a drive unit comprising a stator and a rotor including a shaft, the shaft of the drive unit extending into the chamber of the volute, the impeller being attached to and driven by the shaft;

wherein an air passage is formed in the inlet for allowing air in the chamber to bleed out during operation of the pump;

wherein the pump further comprises a baffle disposed in the inlet, the inlet has a straight central axis and the baffle comprises a guide plate angled to the axis of the inlet;

wherein the guide plate comprises a contact edge contacting an inner surface of the inlet and a free edge spaced from the inner surface of the inlet, a passage through the inlet being formed between the free edge and the inner surface of the inlet;

wherein the baffle further comprises a cylindrical portion extending from the contact edge along a direction parallel to the axis of the inlet, and a mounting portion formed at an end of the cylindrical portion remote from the guide plate, the mounting portion abutting against a shoulder formed in the inlet, adjacent the chamber of the volute;

wherein at least one post is formed on one of the shoulder of the inlet and the mounting portion of the baffle, at least one mounting hole is formed at the other of the shoulder of the inlet and the mounting portion of the baffle, and the at least one post is fixed in the at least one mounting hole.

* * * * *